US005301908A

United States Patent [19]

Reames

[11] Patent Number: 5,301,908

[45] Date of Patent: Apr. 12, 1994

[54] METHOD OF USING AN ARM SUPPORT CUSHION

[76] Inventor: Juanita Reames, 6201 15th NW. P-521, Seattle, Wash. 98107

[21] Appl. No.: 941,541

[22] Filed: Sep. 9, 1992

[51] Int. Cl.[5] ..... B68G 5/00

[52] U.S. Cl. ..... 248/118; 5/640; 297/411.46

[58] Field of Search ..... 248/118; 5/640, 639, 5/652, 485; 297/411, 393; 108/43

[56] References Cited

U.S. PATENT DOCUMENTS

| | | | |
|---|---|---|---|
| 3,009,172 | 11/1961 | Eidam | 5/639 X |
| 4,235,472 | 11/1980 | Sparks et al. | 5/640 X |
| 4,550,458 | 11/1985 | Fiore | 297/393 X |
| 4,683,601 | 8/1987 | Lagin | 5/652 |
| 4,783,866 | 11/1988 | Simmons et al. | 5/639 |
| 4,959,880 | 10/1990 | Tesch | 5/640 X |
| 5,022,622 | 6/1991 | Schaevitz | 248/118 |
| 5,158,255 | 10/1992 | Fuller | 248/118 |
| 5,163,646 | 11/1992 | Engelhardt | 248/118 |
| 5,168,590 | 12/1992 | O'Sullivan | 5/640 X |

FOREIGN PATENT DOCUMENTS

| | | | |
|---|---|---|---|
| 656281 | 1/1938 | Fed. Rep. of Germany | 297/411 |
| 999217 | 7/1965 | United Kingdom | 5/639 |

*Primary Examiner*—Blair M. Johnson

[57] ABSTRACT

An arm support device is provided for use in supporting a person's arms while engaged in an activity such as typing at a keyboard or feeding an infant. The arm support device includes a cushion surrounded by fabric and is divided into a front portion and two side portions extending generally perpendicular to the front portion to form a U-shaped cushion. In use, the U-shaped cushion fits around a person's abdomen with the front portion lying on a person's lap. The side and front portions can support the person's arms when engaged in a stress producing activity. The cushion relieves stress that would otherwise build up within a person's arms and wrists. The device also includes means for vertically adjusting the device for different applications or different sized people. The adjustment feature uses separate smaller cushions that may be inserted into pockets sewn beneath the front and side portions to give the overall cushion a greater height.

1 Claim, 1 Drawing Sheet

METHOD OF USING AN ARM SUPPORT CUSHION

BACKGROUND OF THE INVENTION

Increasing medical problems have been identified among people using keyboards because of muscle fatigue, Carpal Tunnel Syndrome, shoulder strain, neck and back strain, and other repetitive motion disorders. Observation of users of keyboards has indicated that much of the underlying stress is back-related, not just wrist related. The very nature of the finger/hand/-wrist/arm movements creates stress and tension on the shoulders, necks, and arms of keyboard users. Joan Duncan and D. Ferguson published a study of keyboard operations and the effect on the human body in Ergonomics, 1974, emphasizing the need to concentrate on back and neck muscle groups. *Fitting the Task to the Man* notes that the elbows must be close-in to the body and straight with the shoulders. "Lifting the shoulders is strenuous . . . work," according to the author's research. A Swiss ergonomics study in 1982 pointed out that 83% of keyboarders rested their forearms if a devise to do so was available which supports other research which indicate that shoulder and neck muscles suffer during the workday. Various studies have concentrated on methods to relieve the wrist tensions and numerous hard surface and soft surface inventions have been created and marketed to relieve tension and pressure on wrists and forearms. Most have been static devises attached to the keyboard or desktop rather than attached to the keyboard operator.

SUMMARY OF THE INVENTION

It is an object of this invention to provide a method of using an arm support device that supports a person's arms, wrists, and hands in a position to ease tension and stress while engaged in an activity such as typing at a keyboard.

Another object of the invention is to provide an arm support device that has greater overall ergonomic advantages to a person's back, neck and body while their arms are supported on the arm support device.

It is a further object of the invention to provide an arm support device that is portable, easily customizable, inexpensive to manufacture, and easy to use.

Other objects of the invention will be apparent hereinafter from the specification and from the recital of the appended claim, particularly when read in conjunction with the accompanying drawings.

The present invention comprises a portable cushion support that can be customized to each keyboard operator but still provides full support for the muscles that tense and strain during operations.

The invention comprises a method of using a portable ergonomic forearm and shoulder support device designed to ease tension and stress in persons engaged in continuous intense keyboarding activity or intermittent keyboarding activity. The device is held on the lap of the keyboarder while seated and provides cushion support from the elbow to and including the wrists of the keyboarder to maintain horizontal support at a level comfortable for the user. It is important that the elbow is lightly cushioned by the device. Any arm support device that places any significant pressure against the elbow will produce stress along a person's forearm. The device of the present invention resolves this over pressure by lightly cushioning the elbow. It rests on the lap and sides of the user to ensure freedom of movement laterally and vertically. The upper surface of the device is cloth to prevent impediments to movement and comfort is ensured by variable cushioning in the device.

A three part cushion made of porous material with variable degrees of stuffing which fits on the lap of the keyboarder to support the shoulders, arms, elbows and wrists during intense or intermittent keyboarding activity to relieve stress and tension created by the movements involved in typing and keyboarding. The device wraps around the waist of the user to approximate midpoints of the two sides of a person's abdomen. The device is completely portable and usable at different workstation locations. It allows full lateral, horizontal and vertical movement of the body with no rigid support areas to interfere with the full freedom of the user's arms and shoulders.

The device is interposed between the keyboard itself and the person operating the keyboard to provide rest and support for the elbows, forearms and wrists of each arm. The device requires no furniture or hardware expense and therefore allows easy movement of computer workstations.

Several variations on the device could include air cushion support, extra length for comfort, various materials to fit the decor of the office or work environment, additional and/or subtractional cushioning to allow custom adjustment of the support to the user. The device could also be used in a variety of applications. The device may be used in any application where a person's arms need to be supported. For example, the device could be used by mothers holding infants. Many times, a mother's arms will tire while holding and feeding their child. This invention is ideal for supporting a mother's arms while engaged in holding an infant.

This invention is unique in that it addresses all muscles and tension points involved in keyboard operation. It provides a surface and rest area for the elbows which keep the elbows below the shoulders, supporting the upper arm and thereby relieving tension on the shoulder and neck muscles. It provides a full-length forearm support which is comfortable and does not interfere with freedom of movement of the body from side-to-side and along the vertical surface of the keyboard. It settles the wrists of the keyboard user at the most comfortable position below or at the keyboard itself.

DETAILED DESCRIPTION OF THE INVENTION

Figure 1:
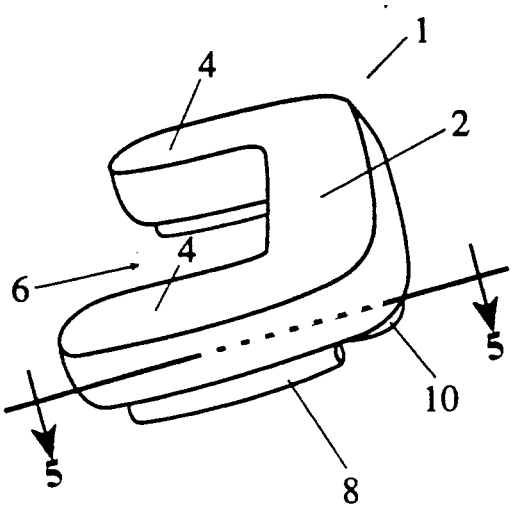
FIG. 1 shows a top perspective view from one side of the arm support device of the present invention.

FIG. 1 shows the preferred embodiment of the arm support device of the present invention. The arm support 1 includes a U-shaped cushion having a front portion 2 connected to a pair of side portions 4 to form a U-shaped opening 6 that fits snugly around a person's abdomen. When positioned in place upon a person, the front portion rests against the front of a person's lower abdomen, and the side portions extend along the sides of the person ending at an approximate mid-point at the side of the person's abdomen. The side portions 4 are horizontally flexible to adjust to a person of any size. Thus, the device can fit as a narrow U-shaped cushion for a relatively thin person, and may be fitted as a wide U-shaped cushion for a heavier person. A front pocket 10 extends along the underside of the front portion 2, and a pair of side pockets 8 extend along the underside of the two side portions 4.

Figure 2:
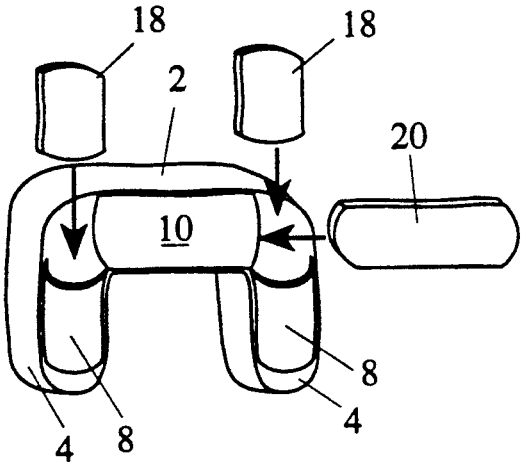
FIG. 2 shows an exploded perspective view from the bottom of the arm support device of FIG. 1.

The adjustability of the arm support device of the present invention is best seen in FIG. 2. The front pocket 10 is designed to hold a separate cushion 20 that extends the height of the front portion of the arm support device. Additional side cusions 18 are housed within side pockets 8 to assist the front cushion 20 in raising the overall height of the arm support device.

Figure 3:
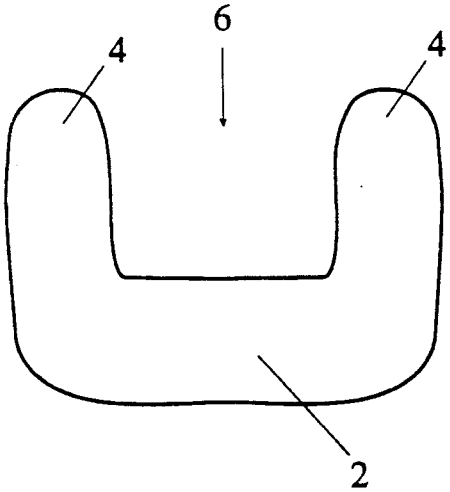
FIG. 3 shows a top plan view of the arm support device of FIG. 1.
Figure 4:
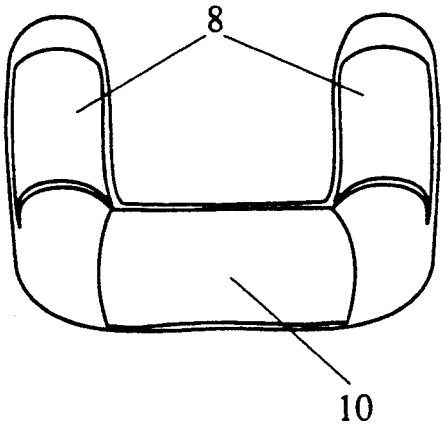
FIG. 4 shows a bottom plan view of the arm support device of FIG. 1.

FIGS. 3 and 4 show plan views of the device that depict the overall shape of the arm support device as U-shaped in configuration. The front and side portions from the U-shaped opening 6 which fits snugly around a person's abdomen.

Figure 5:
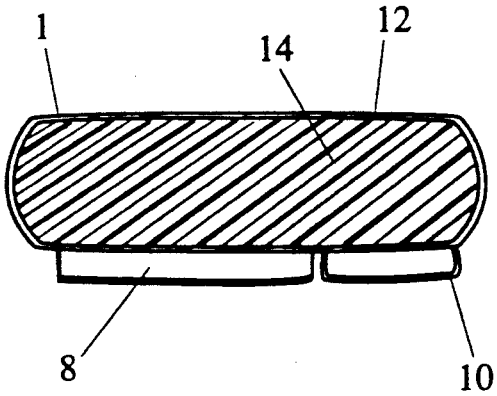
FIG. 5 shows a cross sectional view along the line 5—5 of FIG. 1.

The materials of which the arm support device is made of can best be seen in FIG. 5. The arm support device 1 includes an outer fabric 12 that covers an inner cushion 14. The fabric and cushion can be made of a variety of materials. Primarily the cushion material will be flexible in nature to allow some cushioning or give when a person's arms are resting thereon. The cushion material may be foam padding or other traditional pillow padding materials, or alternatively could consist of only air if the fabric 12 has an inner air-tight surface and a valve for introducing air into the arm support device. The fabric 12 should be made of a soft, non-abrasive material. The fabric could be customized in any number of materials or outward designs. The device could be further customized by having the outer fabric consist of a substitutable slip cover that pulls over the cushion to allow a user to cover any one of many different types of materials and designs over the device.

The overall height of the arm support device can also best be seen in FIG. 5. The device has a normal overall height that is approximately equivalent to the height of cushion 14. When used without the front and side cushions 18 and 20, the pockets 8 and 10 collapse down onto a person's lap when in a sitting position (see FIG. 6). But, if a user wishes to adjust the device to a greater overall height, one merely has to insert the front and side cushions into pockets 8 and 10 which extend the height of the device an incremental height equal to the height of the individual cushions 18 and 20. The pockets 8 and 10 can generally be constructed of the same material that the outer fabric 12 is constructed.

Figure 6:
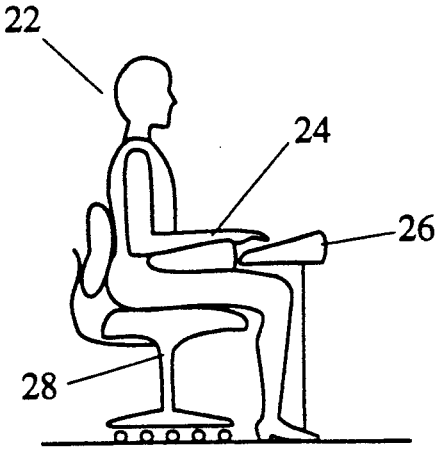
FIG. 6 shows a side view of the arm support device of FIG. 1 in use by a person at a keyboard.

FIG. 6 shows the present invention in use by a person 22. The person's arm rest across the side portions 4 and remain in a level and ergonomically correct position that is horizontal to the keyboard 26. In addition to easing the tension and strain in the person's arms, the arm support device assists the person's body, back and neck in maintaining an ergonomically correct posture while seated in chair 28. This is because the arms are supported on the arm support device which is in turn supported on the person's lap. Hence, the present invention is unique in that the arms continue to be supported fully on the body while in use which prevents the body from maladjusting to unsupported arms or arms supported by a keyboard or desktop attached support. It is more comfortable for the arms to be supported directly on the body as opposed to being supported on a foreign object, keyboard or desktop.

It should be apparent that many modifications could be made to the arm support device which would still be encompassed within the spirit of the present invention. It is intended that all such modifications may fall within the scope of the appended claims.

What is claimed is:

1. A method for using a support cushion to support the arms, wrists and hands of a person while engaging in repetitive motion activity, said cushion having, a flexible, substantially U-shaped support having a front portion and two side portions extending perpendicularly to said front portion, said front portion and two side portions forming three sides of a U-shaped opening within said support, each of said front and two side portions having an upper and a lower surface, said support cushion having an inner cushion surrounded by an outer fabric, said support cushion having a predetermined height to support a person's arms, wrists and hands in a substantially level position when supported across said front and side portions, said method comprising:

placing the support cushion on a person's lap with said front and side portions extending horizontally and said U-shaped opening directed toward the torso of the person, the side and front portions engaging and supporting a substantial portion of the person's arms, wrists and hands in a substantially horizontal position so as to provide support for the arms, wrists and hands while they are engaged in repetitive motion activity.

* * * * *